US006139590A

United States Patent [19]

Moore et al.

[11] Patent Number: 6,139,590

[45] Date of Patent: Oct. 31, 2000

[54] POST-DYE SCREEN COLOR PRINTING

[75] Inventors: Samuel B. Moore; Yonghua Li; Eric M. Henry, all of Burlington, N.C.

[73] Assignee: Burlington Chemical Co., Inc., Burlington, N.C.

[21] Appl. No.: 09/267,741

[22] Filed: Mar. 15, 1999

[51] Int. Cl.[7] ..... D06P 5/12

[52] U.S. Cl. ..... 8/448; 8/478; 8/541; 8/542; 8/552; 8/554; 8/557; 8/561; 8/576; 8/606

[58] Field of Search ..... 8/448, 541, 542, 8/552, 551, 561, 576, 606, 554, 478

[56] References Cited

U.S. PATENT DOCUMENTS

| | | | |
|---|---|---|---|
| 3,907,737 | 9/1975 | Marx et al. | 260/29.6 |
| 4,110,230 | 8/1978 | Hessert et al. | 252/855 |
| 4,276,207 | 6/1981 | Lester et al. | 260/17 |
| 4,585,820 | 4/1986 | Defago et al. | 524/232 |

FOREIGN PATENT DOCUMENTS

| | | |
|---|---|---|
| 380770 | 6/1970 | U.S.S.R. . |
| 2123856 | 2/1984 | United Kingdom . |

OTHER PUBLICATIONS

Article entitled "Nylon Technology" from Textile Technology Series; McGraw–Hill Book Co., Inc. 1953.

Glossary from The Thames and Hudson Manual of Textile Printing; 1974.

Clamp Reisit dyeing of Fabrics from Calico Museum of Textiles, 1977.

Article entitled Printing on Cellulose from Textile Printing;1995.

*Primary Examiner*—Margaret Einsmann

*Attorney, Agent, or Firm*—Rhodes & Mason, PLLC

[57] ABSTRACT

A dyeing and printing system for use in color printing articles or fabrics formed from cellulose prior to dyeing. In the preferred embodiment, the dyeing system composition includes the selective use of a dye blocking print paste, a color binder print paste and a dye enhancing print paste to selectively decrease or increase the shade of the dyed portions of a cellulose article, such as a woven or knitted cotton or cotton/polyester article or fabric while, at the same time, permitting the resisted areas to be colored differently.

69 Claims, 1 Drawing Sheet

POST-DYE SCREEN COLOR PRINTING

BACKGROUND OF THE INVENTION (1) Field of the Invention

The present invention relates generally to color printing cellulosic articles and, more particularly, to a new method of screen printing fabrics, in which the fabric article is first selectively printed with a dye blocking print paste, then printed with a color binder print paste over at least a portion of the area printed with the dye blocking print paste and finally printed with a dye enhancing print paste and subsequently dyed to bring out the print.

(2) Description of the Prior Art

Traditional screen printing of garments is done by printing ink, binder, thickener and softener combinations on dyed or white prepared for print (PFP) garments. A detailed description of the screen printing process is published in the Encylopedia of Textiles, Second Edition, 1972 Prentice-Hall, Inc., Englewood Cliffs N.J., the disclosure of which is hereby incorporated by reference in its entirety. The following discussion is taken from the above-referenced Encyclopedia of Textiles.

The screen printing method in textiles is basically a stencil process. A wooden or metal frame is covered with a bolting cloth, which may be made of silk, fine metal thread, or nylon. The fabric is covered with a film and the design areas are cut out of the film just as in stencil making. The frame is then laid on the fabric and color is brushed or squeezed through the open areas of the film by the use of a big rubber knife or squeegee.

Originally, the design was cut out of film and then adhered to the screen. Today the cutting is done mechanically by a photo-chemical process which reproduces the design exactly as it was painted in the art which is being reproduced.

In printing, one screen is used for each color and these are accurately registered one on the other by the use of fixed stops attached to an iron rail running the length of the table. The length of the table determines the number of yards which can be printed at one laying; this varies depending on the available space, though 30 yards is considered the smallest space which is practical for economic production.

While screen printing, either by hand or machine, is a slower and more expensive process than roller printing, it has several virtues. From the point of view of design, pattern repeats can be much larger than in roller printing. Also, since the process is slower, pigment colors can be laid on in heavy layers to produce a handicraft effect. From an economic point of view, it does not require as large an investment as roller printing because the runs can be shorter, especially in the hand operation. This has encouraged smaller converters to adopt the screen method and to experiment more with design than they would be able to do in the roller method, where they would be required to contract for a minimum of about 8000 yards per pattern.

One of the most important physical parameters for good screen printing is that the print paste is thick enough to stand in a gel state until it is dried and cured. This assures clean crisp definition of the print. However, the print paste still must flow readily and evenly. These two properties are defined as the rheology of the print paste and the most desirable property is called pseudo-plastic or the ability of the paste to become less viscous when moved by pump or mechanical device and to thicken or become more viscous when it stills.

Because of the nature of the print paste, screen prints are generally opaque and rubbery to the touch. In addition, these prints are not very durable especially when washed. There has been much work done in developing softer prints that do not crack and peel after washing and these softened prints are called "plastisols," but they are still based on pigments, binder, thickener and are still a surface coating which can be "felt".

One approach to solving this problem is disclosed in U.S. patent application Ser. No. 08/922,221, filed Sep. 2, 1997, now U.S. Pat. No. 5,984,977, which is hereby incorporated by reference in its entirety. However, some dye sites may still remain when using the teachings in this application. These sites may be sufficient to prevent multiple color dyeing since small traces of dyes may make true colors more difficult to achieve.

Another approach to solving this problem is disclosed in U.S. patent application Ser. No. 09/260,841. filed Mar. 2, 1999 which is hereby incorporated by reference in its entirety. However, this invention was still limited to producing dye-free, base and dark dyed regions of a single color.

Thus, there remains a need for a new method of screen printing in which the garment or fabric may be color printed using traditional screen printing techniques while, at the same time, provides printed areas which can not be rubbed off or felt to the touch.

SUMMARY OF THE INVENTION

The present invention is directed to a dyeing and printing system for use in color printing articles or fabrics formed from cellulose prior to dyeing. In the preferred embodiment, the dyeing system composition includes the selective use of a dye blocking print paste, a color binder print paste and a dye enhancing print paste to selectively decrease or increase the shade of the dyed portions of a cellulose article, such as a woven or knitted cotton or cotton/polyester article or fabric while, at the same time, permitting the resisted areas to be colored differently.

In the preferred embodiment, the dye blocking print paste includes a thickener and dye blocking agents. The dye blocking agents includes an ether-forming cross-linking resin, which may be pre-catalyzed, an ester-forming cross-linking resin, a reductive catalyst and a dye resist.

In the preferred embodiment, the color binder print paste includes an organic pigment; a cross-linking, polymeric binder; a thickener and the balance water. The cross-linking, polymeric binder is preferably a water-based, film forming binder such as a mixture of homopolymers and copolymers of polyacrylic acid. In order to keep the hand of the fabric smooth, the cross-linking, polymeric binder has a Tg (glass transition temperature) less than about 10° F. and, preferably, a Tg between about −20° F. and −45° F.

Also, in the preferred embodiment, the dye enhancing print paste includes a thickener and an epoxy functional quaternary ammonium-enhancing agent. The thickener for both print pastes, preferably, is an acid alkali stable hydroxypropyl guar derivative, polysaccharide, dispersed in an invert emulsion.

Accordingly, one aspect of the present invention is to provide a dyeing and printing system for use in color printing articles formed from cellulose prior to dyeing. The composition includes: a layer of a dye blocking print paste; and a layer of a color binder print paste printed on the surface of the first layer of dye blocking print paste.

Another aspect of the present invention is to provide a dyeing and printing system for use in color printing articles formed from cellulose prior to dyeing. The composition includes: a layer of a dye blocking print paste, the dye blocking print paste including: (i) a thickener; and (ii) dye blocking agents, the dye blocking agents including an ether-forming, cross-linking resin, an ester-forming, cross-linking resin, a catalyst and a dye resist; and a layer of a color binder print paste printed on the surface of the first layer of dye blocking print paste.

Still another aspect of the present invention is to provide a dyeing and printing system for use in color printing articles formed from cellulose prior to dyeing. The composition includes: a layer of a dye blocking print paste, the dye blocking print paste including: (i) a thickener; and (ii) dye blocking agents, the dye blocking agents including an ether-forming, cross-linking resin, an ester-forming, cross-linking resin, a catalyst and a dye resist; a layer of a color binder print paste printed on the surface of the first layer of dye blocking print paste; and a dye enhancing print paste, the dye enhancing print paste including: (i) a thickener and (ii) an enhancing agent.

These and other aspects of the present invention will become apparent to those skilled in the art after a reading of the following description of the preferred embodiment when considered with the drawings and examples.

DESCRIPTION OF THE PREFERRED EMBODIMENTS

Figure 1:
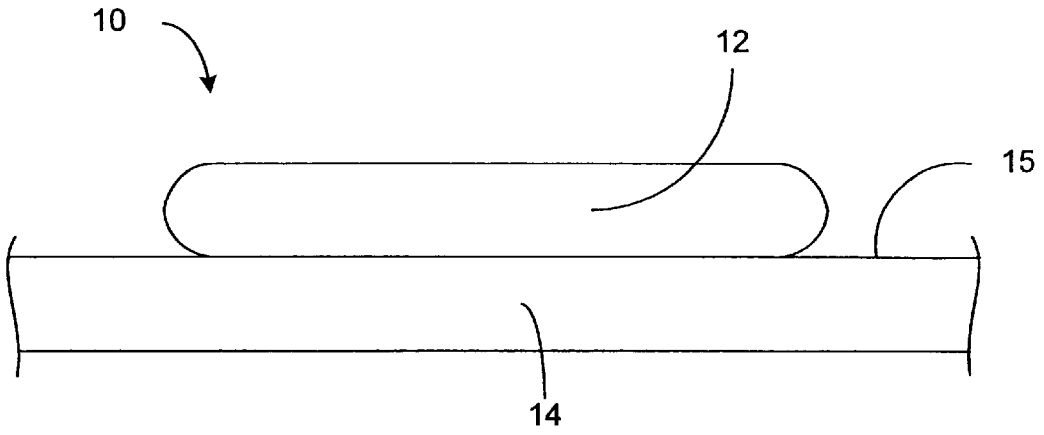
FIG. 1 shows a cross-sectional view of a partially treated cellulosic fabric constructed according to the present invention.

In the following description, like reference characters designate like or corresponding parts throughout the several views. Also in the following description, it is to be understood that such terms as "forward," "rearward," "left," "right," "upwardly," "downwardly," and the like are words of convenience and are not to be construed as limiting terms.

The present invention is performed in the reverse order of traditional garment or fabric screen printing. According to the present invention, the garment or fabric is print prepared (e.g. scoured and bleached white) or griege (unprepared) with a chemical system including a dye blocking print paste and a dye enhancing print paste. The dye blocking print paste includes a wetting agent, a thickener paste; and dye blocking agents, the dye blocking agents including a cross-linking resin and a dye resist to selectively decrease the shade of the dye. In the preferred embodiment, the dye enhancing print paste includes a wetting agent, thickener and a dye enhancing agent which is used to selectively increase the shade of the dye.

In the preferred embodiment, the thickener paste for both the dye blocking and the dye enhancing print paste is an acid alkali stable hydroxypropyl guar derivative, polysaccharide, dispersed in an invert emulsion. Specifically, the polysaccharide concentrate includes about 35 weight percent water, 10 weight percent emulsifier, 10 weight percent polysaccharide and 45 weight of a petrol solvent.

Also, the cross-linking resins used in the dye blocking print paste are preferably glyoxal resins and polycarboxylic acids. In the preferred embodiment, one of the dye resists used in the dye blocking print paste is a low molecular weight polyacrylic acid having a molecular weight of about 2000. One suitable dye resist is sold under the tradename BURCO® Dye Resist 118 by Burlington Chemical Company, Inc. of Burlington, N.C., the assignee of the present invention.

Finally, the enhancing agent used in the dye enhancing print paste is preferably an epoxy functional quaternary ammonium compound. One suitable dye enhancer is sold under the tradename BURCO® DCE by Burlington Chemical Company, Inc. of Burlington, N.C., the assignee of the present invention.

The cellulosic article, garment or fabric is then dyed to the desired shade with the dye blocking and dye enhancing print pastes selectively either reducing the amount of dye on the fabric or enhancing the dye on the fabric. If we measure the background and set it arbitrarily as 100%, the enhanced regions are 250% deeper in color and the blocked regions are 99% lighter than the background.

Further examples of the present invention can be seen in a camo print on 100% cotton knit fabric where various concentrations of the enhancer chemical are printed on and then dyed.

The present invention can be best understood by a review of the following examples:

EXAMPLES 1–2

A dye blocking print paste was prepared using both pre-catalyzed glyoxal resin and a conventional glyoxal resin according to the amounts in weight percent shown in Table 1. Cotton fabric was printed with the dye blocking print paste, the print paste was allowed to dry and cure and conventional reactive and direct dyeing were made. The results are shown in Table 1, below:

TABLE 1

| Ex. | Paste | Pre-Catalyzed Glyoxal Resin | Glyoxal Resin | Poly-Acrylic Acid | Wetting Agent | Shade Difference |
|---|---|---|---|---|---|---|
| 1 | 15 wt. % | 15 wt. % | — | 5 wt. % | 0.1 wt. % | −90% |
| 2 | 15 wt. % | — | 15 wt. % | 5 wt. % | 0.1 wt/ % | No Effect! |

As can be seen, only the dye blocking print paste including a pre-catalyzed glyoxal resin was effective in blocking the dye.

EXAMPLES 3–6

A dye blocking print paste was prepared using pre-catalyzed glyoxal resin according to the amounts in weight percent shown in Table 2. Cotton fabric was printed with the dye blocking print paste, the print paste was allowed to dry and cure and conventional reactive and direct dyeing were made. The results are shown in Table 2, below:

TABLE 2

| Ex. | Paste | Pre-Catalyzed Glyoxal Resin | Glyoxal Resin | Poly-Acrylic Acid | Wetting Agent | Shade Difference |
|---|---|---|---|---|---|---|
| 3 | 15 wt. % | 15 wt. % | — | 5 wt. % | 0.1 wt. % | −90% |
| 4 | 15 | 10 wt. % | — | 5 wt. % | 0.1 wt. % | −60% |

TABLE 2-continued

| Ex. | Paste | Pre-Catalyzed Glyoxal Resin | Glyoxal Resin | Poly-Acrylic Acid | Wetting Agent | Shade Difference |
|---|---|---|---|---|---|---|
| | wt. % | | | | | |
| 5 | 15 wt. % | 5 wt. % | — | 5 wt. % | 0.1 wt. % | −30% |
| 6 | 15 wt. % | 2.5 wt. % | — | 5 wt. % | 0.1 wt. % | −10% |

As can be seen, the dye blocking print paste having between about 5 to 15 wt. % pre-catalyzed glyoxal resin produced a linear relationship between the weight percent of resin and the shade difference in blocking the dye.

EXAMPLES 7–10

A dye blocking print paste was prepared using pre-catalyzed glyoxal resin according to the amounts in weight percent shown in Table 3 and both with and without poly-acrylic acid. Cotton fabric was printed with the dye blocking print paste, the print paste was allowed to dry and cure and conventional reactive and direct dyeing were made. The results are shown in Table 3, below:

TABLE 3

| Ex. | Paste | Pre-Catalyzed Glyoxal Resin | Glyoxal Resin | Poly-acrylic Acid | Wetting Agent | Shade Difference |
|---|---|---|---|---|---|---|
| 7 | 15 wt. % | 15 wt. % | — | 5 wt. % | 0.1 wt. % | −90% |
| 8 | 15 wt. % | 15 wt. % | — | — | 0.1 wt. % | −60% |
| 9 | 15 wt. % | 2.5 wt. % | — | — | 0.1 wt. % | No Effect! |
| 10 | 15 wt. % | — | — | 15 wt. % | 0.1 wt. % | No Effect! |

As can be see, the addition of polyacrylic acid improved the effectiveness of the dye blocking print paste 50% when comparing Example 7 to Example 8. In addition, only the dye blocking print paste including a pre-catalyzed glyoxal resin was effective in blocking the dye even when the amount of polyacrylic acid was increase to 15 wt. %.

Dyeings were than made using the thickener of the present invention along with a conventional epoxy functional quaternary ammonium compound to form a dye enhancing print paste. This compound has been used in the past to react with cellulose to yield a permanent cationic site on the cellulose to improve dye yield. If we measure the background and set it arbitrarily as 100%, the enhanced regions were 250% deeper in color than the background when dyed with fiber reactive and direct dyes.

Finally, fabric was screen printed using a combination of the blocking print paste and enhancing print paste according to the present invention. Dyeing to the desired shade with the blocking and enhancing print pastes selectively either reduced the amount of dye on the fabric or enhanced the dye on the fabric. If we measure the background and set it arbitrarily as 100%, the enhanced regions were 250% deeper in color and the blocked regions were 90% lighter than the background!

In a further improved embodiment as disclosed in U.S. patent application Ser. No. 09/260,841 filed Mar. 2, 1999 the dye blocking agents may include a pre-catalyzed ether-forming cross-linking resin, an ester-forming cross-linking resin, a catalyst and a dye resist. It has been discovered that the addition of an ester-forming cross-linking resin and catalyst improves the strength, the light scattering (KS value) and further reduces the excluded dye sites of the resist portion of the fabric as shown below.

EXAMPLES 11–13

Dye blocking print pastes were prepared using a thickener and different dye blocking agents and a dye resist. The dye blocking agents included only a pre-catalyzed, ether-forming, cross-linking resin; only an ester-forming, cross-linking resin and a catalyst; and the combination of a pre-catalyzed, ether-forming, cross-linking resin, an ester-forming, cross-linking resin, and a catalyst. Cotton fabric was printed with the dye blocking print paste, the print paste was allowed to dry and cure and conventional reactive and direct dyeing were made. The results are shown in Table 4, below:

TABLE 4

| Ex. | Dye Blocking Agent | Fabric Strength (compared to untreated fabric) | Light Scatter (KS value) | Excluded Dye Sites |
|---|---|---|---|---|
| 11 | Pre-Catalyzed Ether-forming, cross linking Resin (only) | 60% | 100% (base) | 98% |
| 12 | Ester-forming, cross linking Resin (only) | 100% | 70% | 97% |
| 13 | Both resins (present invention) | 100% | 140% | 99% |

As can be seen, the dye blocking print paste including the additional cross-linking resin and catalyst is a significant improvement.

In the preferred embodiment, the ester-forming cross-linking resin are carboxylic acids. Specifically, the resin is a 50/50 mixture of polymaleic acid and butanetetracarboxylic acid at between about 5 to 15 weight percent of the total weight percent of the dye blocking print paste with about 8 weight percent of the total weight of the dye blocking print paste being preferred.

Also, in the preferred embodiment, the catalyst is reductive with sodium hypophosiphite at a 1 to 4 ratio to the ester-forming cross-linking resin being preferred.

A cellulosic article, garment or fabric dyed to the desired shade with the improved blocking print paste further reduces the amount of dye on the fabric. If we measure the background and set it arbitrarily as 100%, the enhanced regions are still 250% deeper in color and the improved blocked regions are 99% lighter than the background.

As discussed above, traditional methods for printing apparel, more particularly cellulosic articles, garments or fabric, involve dyeing and otherwise treating the fabric in a continuous roll or by batch system processing, followed by cut and sew operations, and finally printing onto the dyed garment. According to the present invention as claimed herein, the traditional process is substantially reversed. First the undyed fabric is cut and sewn into garments; then the individual garments are printed; and lastly the printed garments are dyed. This allows very quick turnaround since the garments and fabrics are pre-printed and the color develops during dyeing.

In a preferred embodiment of the present invention, the dye blocking print paste, including the dye blocking agents, is applied directly to the undyed textile garment after the cut and sew operations or processes have been performed. Fabrics may also be printed before dyeing or cut and sew. Application of the dye blocking print paste is directed to regions where a printed design is desired.

The dye blocking agents essentially create a color-free "white" region; a portion or all of which can be used for accepting the color binder print paste. Thus, the true color of the pigment used in the color binder print paste is visible after the final garment dyeing process. Surprisingly, the resultant printed area, including dye blocking agents and application of the color binder print paste, has greater durability compared to a printed area created with a pigment and binder alone.

Referring now to the drawings in general and FIG. 1 in particular, it will be understood that the illustrations are for the purpose of describing a preferred embodiment of the invention and are not intended to limit the invention thereto. As best seen in FIG. 1, a multi-color dyeing and printing system, generally designated 10, is shown constructed according to the present invention. As shown in FIG. 1, the portion of the fabric printed with the dye blocking print paste 12 swells the fabric's fibers 14 so that the fibers absorb some of the dye blocking agents, while some of the dye blocking agents remain on the fabric surface 15.

Figure 2:
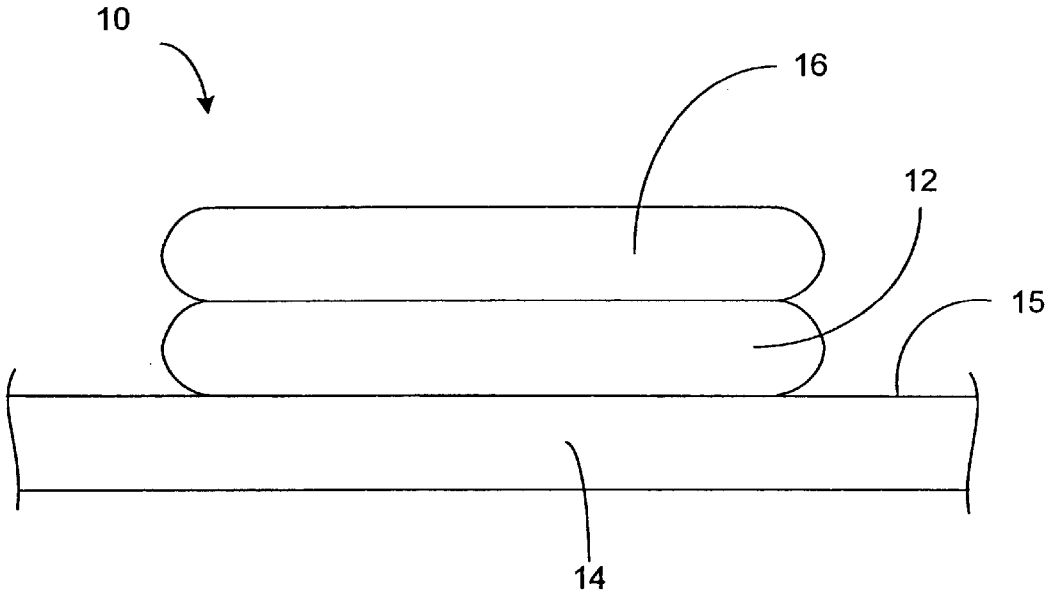
FIG. 2 shows a cross-sectional view of a fully treated fabric.

Following the application of the dye blocking agents onto a predetermined design area, at least the treated design area is flash dried via exposure to an infrared dryer. Then, a color binder print paste is applied directly onto at least a portion of the design area already treated with dye blocking agent, as best seen in FIG. 2. In the preferred embodiment, printing of the color binder print paste layer is improved when at least some of the water is not removed from the treated printed design area during the dye blocking print paste flash drying step.

The color binder print paste forms a pigment containing film on the dye blocking print paste-treated design area of the garment. Then, the treated design area is again flash dried. Significantly and surprisingly, some interaction appears to occur between the dye blocking agents in the dye blocking print paste and the color binder print paste. Finally, the treated design area is cured. In a preferred embodiment, the cure process involves about two minutes exposure to 350° F.

In the preferred embodiment, the color binder print paste comprises a pigment, a cross-linking polymeric binder, and the balance water. In the preferred embodiment, the pigment may be an organic pigment or an inorganic pigment. More preferably, the pigment is an organic pigment selected from the group consisting of mono-azo, dis-azo, phthalolyanine, azo methine, anthaquinone, perinone, perylene, and quinacridone pigments as described in Chapter 15 of *Dye and Their Intermediates* by Abrahunt (Second Edition 1977) which is hereby incorporated by reference in its entirety.

Also in a preferred embodiment, the pigment shade is controlled by varying the weight percent of the pigment in the color binder print paste between about 0.001 and 10 wt. %, depending upon the color preference.

Preferably, the cross-linking polymeric binder is a water-based, film-forming binder. Consistent with industry convention, a "film" is defined in the Modern Plastics Encyclopedia (as referenced by *Synthetic Binders for Pigment Printing, The Pigment Printing Handbook* published by the American Association of Textile Chemists and Colorists (1995) which is hereby incorporated by reference in its entirety), as "a flat section of a thermoplastic resin or a regenerated cellulosic material that is very thin in relation to its length and breadth and has a nominal thickness not greater than 0.25 mm."

Various film-forming materials are commercially available, having a range of densities, melt indexes, copolymers and blends, including additives for plasticizing, coloring, impact modification, ultraviolet stabilization, fire retardence, biodegradability and durability, as also set forth in the above references.

More preferably, the water-based, film-forming, cross-linking polymeric binder is a low crock binder, for example a homo-copolymer polyacrylic acid available from Eastern Color and Chemical Company of Providence, R.I. Also preferably, the cross-linking polymeric, water-based, film-forming binder is a soft polymer; that is, it has a Tg of less than about 10° F. More preferably, the polymeric binder has a Tg between about −20° F. and −45° F. Additionally, the polymeric binder is preferably between about 0.01 wt. % and 35 wt. % by weight of the color binder print paste.

In a preferred embodiment, the color binder print paste further includes a thickener, preferably a polyacrylic acid, for example, ASE60 commercially available from the Rhoman Hass Co of Philadelphia, Pa. More preferably, the thickener is used to adjust the color binder print past to a viscosity of about 10,000 cps.

Also in a preferred embodiment, the color binder print paste further includes a pH adjacent to adjust the pH of the color binder print paste to between about 7 and 12 pH; more preferably, the pH adjuster is ammonia.

In a further improved embodiment as claimed in the present invention, the multi-color dyeing and printing system may include multiple color binder print pastes having pigments of different colors and/or shades.

Additionally, according to an improved embodiment as claimed in the present invention, the multi-color dyeing and printing system may include a color binder print paste having a pigment and a cross-linking polymeric binder, where the binder includes an ether-forming cross-linking resin applied in sequential laminate combination with the dye blocking agents, which may include a pre-catalyzed ether-forming cross-linking resin, an ester-forming cross-linking resin, a catalyst and a dye resist, the color binder print paste interacts with the dye blocking agents to form cross-links. It has been discovered that the addition of a water-based, film-forming binder having a cross-linking resin improves the durability and color retention by further reducing the excluded or printed dye sites of the treated design area of the fabric as shown below.

EXAMPLES 14–18

The multi-color dyeing and printing system was evaluated using different combinations of dye blocking print pastes and color system variations. The variations of the color system were prepared using pigments, cationic dyes, vat dyes, and bifunctional reactive dyes with the dye blocking print paste. Cotton fabric was printed with the dye blocking print paste and each of these color systems which was then flash dried; then cured and conventional reactive and direct dyeing were made of the entire garment sample. The results are shown in Table 5, below (note that durability was rated on a scale of 1–5, with 5 being most durable):

TABLE 5

| Ex. | Color Binder System | Color Retention | Durability |
|---|---|---|---|
| 14 | Pigment (only) | About 10% | 1 |
| 15 | Cationic Dye (only) | 25–30% | 2 |
| 16 | Vat Dye (only) | Less than 10% | 1 |
| 17 | Bifunctional Fiber Reactive Dye (only) | About 10% | 1 |
| 18 | Pigment & Cross-linking Polymeric Binder (present invention) | 100% | 5 |

As can be seen, the multi-color dyeing and printing system including both a pigment and a cross-linking polymeric binder was a substantial and significant improvement over the alternative approaches.

Thus, a cellulosic article, garment or fabric dyed to the desired shade with the improved dye blocking agents and printed with the color binder print paste according to the present invention substantially eliminates the amount of false dyeing on the fabric in the treated print design area, thereby providing true print colors in the design area even after dyeing. If we measure the background and set it arbitrarily as 100%, the improved blocked regions are at least 99% lighter or "whiter" than the background, and, as a result, the multi-color printed area is true to the pigment color and shade.

EXAMPLES 19–22

The multicolor dyeing and printing system of the present invention was evaluated using different combinations of dye blocking agents and color binder print paste, including different process steps. The variations of the color binder system combinations were prepared using the following processes:

EXAMPLE 19

Cotton fabric was printed with the dye blocking print paste which was flash dried; then the treated fabric area was printed with color binder print paste and flash dried; then conventional reactive and direct dyeing were made (not curing step).

EXAMPLE 20

Cotton fabric was printed with a mixture of the dye blocking print paste and the color binder print paste and flash dried; then cured, and conventional reactive and direct dyeing were made.

EXAMPLE 21

Cotton fabric was printed with the dye blocking print paste which was flash dried; then the treated fabric area was printed with color binder print paste having no binder, but only pigment and flash dried; then cured and conventional reactive and direct dyeing were made.

EXAMPLE 22 (The Present Invention)

Cotton fabric was printed with the dye blocking print paste which was flash dried; then the treated fabric area was printed with color binder print paste and flash dried; then cured and conventional reactive and direct dyeing were made. The results are shown in Table 6, below:

TABLE 6

| Color Binder System | Color Retention |
|---|---|
| Ex. 19 | About 10% |
| Ex. 20 | About 10% |
| Ex. 21 | Less than 10% |
| Ex. 22 Dye Blocking Agents applied 1st, then flash dried; Color Binder Print Paste allied 2nd then flash dried & cured (present invention) | 100% |

As can be seen, the multi-color dyeing and printing system, including a pigment and a cross-linking polymeric binder applied as a laminate after application of the dye blocking print paste, was again a significant improvement over the alternative approaches.

Certain modifications and improvements will occur to those skilled in the art upon a reading of the foregoing description. By way of example, while the preferred embodiment of this invention is directed to color printing cotton and cotton/polyester fabrics, it could be easily adapted to color printing other cellulosic articles. Also, non-polymer organic acids, such as citric acid, maleic acid and BTCA, other cationics and other thickeners may work. It should be understood that all such modifications and improvements have been deleted herein for the sake of conciseness and readability but are properly within the scope of the following claims.

We claim:

1. A dyeing and printing composition for use in color printing articles formed from cellulose prior to dyeing, said composition comprising:

(a) a first layer of a dye blocking print paste;

(b) a second layer of a color binder print paste printed on the surface of said first layer of dye blocking print paste; and (c) a third layer of a dye enhancing print paste printed on said second layer of said color binder print paste, said dye enhancing print paste including: i) a thickener, wherein said thickener for said dye enhancing paste is an alkali stable concentrate comprising a polysaccharide; and ii) an enhancing agent, wherein said enhancing agent is a quaternary ammonium compound.

2. The composition according to claim 1, wherein said alkali stable concentrate is stable between a pH range of about 7.5 to 10.0.

3. The composition according to claim 1, wherein said thickener for said dye enhancing print paste is about 15 weight percent of the total weight of said dye enhancing print paste.

4. The composition according to claim 1, wherein said quaternary ammonium compound is between about 1 to 10 weight percent of the total weight of said dye enhancing print paste.

5. The composition according to claim 1, wherein said quaternary ammonium compound is an epoxy functional quaternary ammonium compound.

6. The composition according to claim 1, wherein said dye enhancing print paste further includes an alkali donor.

7. The composition according to claim 1, wherein said dye enhancing print paste further includes a wetting agent.

8. The composition according to claim 7, wherein said wetting agent is about 0.1 weight percent of the total weight of said dye enhancing print paste.

9. A dyeing and printing composition for use in color printing articles formed from cellulose prior to dyeing, said composition comprising:

(a) a first layer of a dye blocking print paste, said dye blocking print paste including: (i) a thickener, wherein said thickener for said dye blocking print paste is an acid stable concentrate comprising a polysaccharide; and (ii) dye blocking agents, said dye blocking agents including an ether-forming, cross-linking resin, an ester-forming, cross-linking resin, a catalyst and optionally a dye resist; wherein said ether-forming cross-linking resin is a pre-catalyzed glyoxal resin, said catalyst is reductive, and said dye resist is a low molecular weight polyacrylic acid; and (b) a second layer of a color binder paste printed on the surface of said first layer of dye blocking print paste, wherein said color binder print paste includes: (i) a pigment; (ii) a cross-linking, polymeric binder; and the balance water.

10. The composition according to claim 9, wherein said acid stable concentrate is stable between a pH range of about 6.5 to 3.5

11. The composition according to claim 9, wherein said polysaccharide acid stable concentrate includes about 35 weight percent water, 10 weight percent emulsifier, 10 weight percent polysaccharide and 45 weight of a petrol solvent.

12. The composition according to claim 9, wherein said thickener for said dye blocking print paste is about 15 weight percent of the total weight of said dye blocking print paste.

13. The composition according to claim 9, wherein said ether-forming cross-linking resin is between about 5 to 15 weight percent of the total weight of said dye blocking print paste.

14. The composition according to claim 9, wherein said low molecular weight polyacrylic acid is between about 0 and 5 weight percent of the total weight of said dye blocking print paste.

15. The composition according to claim 9, wherein said polyacrylic acid is a low molecular weight acid having a molecular weight of about 2000.

16. The composition according to claim 9, wherein said dye blocking print paste further includes a wetting agent.

17. The composition according to claim 16, wherein said wetting agent is about 0.1 weight percent of the total weight of said dye blocking print paste.

18. The composition according to claim 9, wherein said ester-forming crosslinking resin is a 50/50 mixture of polymaleic acid and butanetetracarboxylic acid.

19. The composition according to claim 9, wherein said ester-forming cross-linking resin is between about 5 to 15 weight percent of the total weight of said dye blocking print paste.

20. The composition according to claim 19, wherein said ester-forming cross-linking resin is about 8 weight percent of the total weight of said dye blocking print paste.

21. The composition according to claim 9, wherein said catalyst is sodium hypophosphite.

22. The composition according to claim 21, wherein said catalyst is about a 1 to 4 ratio to said ester-forming cross-linking resin.

23. The composition according to claim 9, wherein said pigment is selected from the group consisting of inorganic and organic pigments.

24. The composition according to claim 23, wherein said pigment is an organic pigment selected from the group consisting of mono-azo, dis-azo, phthalolyanine, azo methine, anthaquinone, perinone, perylene, and quinacridone pigments.

25. The composition according to claim 9, wherein said cross-linking, polymeric binder is a water-based, film forming binder in the color binder print paste.

26. The composition according to claim 25, wherein said water-based, film forming binder is a mixture of homopolymers and copolymers of polyacrylic acid.

27. The composition according to claim 9, wherein said cross-linking, polymeric binder has a Tg less than about 10° F.

28. The composition according to claim 27, wherein said cross-linking, polymeric binder has a Tg between about −20° F. and −45° F.

29. The composition according to claim 9, wherein said cross-linking, polymeric binder is between about 0.01 and 35 weight percent of the total weight of said color binder print paste.

30. The composition according to claim 9, wherein said thickener adjusts the viscosity of said color binder print paste to about 10,000 cps.

31. The composition according to claim 9, further including a pH adjuster.

32. The composition according to claim 31, wherein said pH adjuster sets the pH of said color binder print paste to between about 7 and 12.

33. The composition according to claim 32, wherein said pH adjuster is ammonia.

34. A dyeing and printing composition for use in color printing articles formed from cellulose prior to dyeing, said composition comprising:

(a) a first layer of a dye blocking print paste, said dye blocking print paste including: (i) a thickener, wherein said thickener for said dye blocking print paste is an acid stable concentrate comprising a polysaccharide; and (ii) dye blocking agents, said dye blocking agents including an ether-forming, cross-linking resin, an ester-forming, cross-linking resin, a catalyst and optionally a dye resist, wherein said ester-forming cross-linking resin is a carboxylic acid, said catalyst is reductive, and said dye resist is a low molecular weight polyacrylic acid;

(b) a second layer of a color binder print paste printed on the surface of said first layer of a dye blocking print paste, wherein said color binder print paste include: (i) a pigment; (ii) a cross-linking, polymeric binder; and the balance water; and (c) a third layer of a dye enhancing print paste printed on said second layer of said color binder print paste, said dye enhancing print paste including: (i) a thickener, wherein said thickener for said dye enhancing print paste is an alkali stable concentrate comprising a polysaccharide, and (ii) an enhancing agent, wherein said enhancing agent is a quaternary ammonium compound.

35. The composition according to claim 34, wherein said alkali stable concentrate is stable between a pH range of about 7.5 to 10.0.

36. The composition according to claim 34, wherein said thickener for said dye enhancing print paste is about 15 weight percent of the total weight of said dye enhancing print paste.

37. The composition according to claim 34, wherein said quaternary ammonium compound is between about 1 to 10 weight percent of the total weight of said dye enhancing print paste.

38. The composition according to claim 34, wherein said quaternary ammonium compound is an epoxy functional quaternary ammonium compound.

39. The composition according to claim 34, wherein said dye enhancing print paste further includes an alkali donor.

40. The composition according to claim 34, wherein said dye enhancing print paste further includes a wetting agent.

41. The composition according to claim 40, wherein said wetting agent is about 0.1 weight percent of the total weight of said dye enhancing print paste.

42. The composition according to claim 34, wherein said acid stable concentrate is stable between a pH range of about 6.5 to 3.5.

43. The composition according to claim 34, wherein said polysaccharide acid stable concentrate includes about 35 weight percent water, 10 weight percent emulsifier, 10 weight percent polysaccharide and 45 weight of a petrol solvent.

44. The composition according to claim 34, wherein said thickener for said dye blocking print paste is about 15 weight percent of the total weight of said dye blocking print paste.

45. The composition according to claim 34, wherein said ether-forming cross-linking resin is between about 5 to 15 weight percent of the total weight of said dye blocking print paste.

46. The composition according to claim 34, wherein said low molecular weight polyacrylic acid is between about 0 and 5 weight percent of the total weight of said dye blocking print paste.

47. The composition according to claim 34, wherein said polyacrylic acid is a low molecular weight acid having a molecular weight of about 2000.

48. The composition according to claim 34, wherein said dye blocking print paste further includes a wetting agent.

49. The composition according to claim 48, wherein said wetting agent is about 0.1 weight percent of the total weight of said dye blocking print paste.

50. The composition according to claim 34, wherein said ester-forming crosslinking resin is a 50/50 mixture of polymaleic acid and butanetetracarboxylic acid.

51. The composition according to claim 34, wherein said ester-forming cross-linking resin is between about 5 to 15 weight percent of the total weight of said dye blocking print paste.

52. The composition according to claim 51, wherein said ester-forming cross-linking resin is about 8 weight percent of the total weight of said dye blocking print paste.

53. The composition according to claim 34, wherein said catalyst is sodium hypophosphite.

54. The composition according to claim 34, wherein said catalyst is about a 1 to 4 ratio to said ester-forming cross-linking resin.

55. The composition according to claim 34, wherein said pigment is selected from the group consisting of inorganic and organic pigments.

56. The composition according to claim 55, wherein said pigment is an organic pigment selected from the group consisting of mono-azo, dis-azo, phthalolyanine, azo methine, anthaquinone, perinone, perylene, and quinacridone pigments.

57. The composition according to claim 34, wherein said cross-linking, polymeric binder is a water-based, film forming binder.

58. The composition according to claim 34, wherein said water-based, film forming binder is a mixture of homopolymers and copolymers of polyacrylic acid.

59. The composition according to claim 34, wherein said cross-linking, polymeric binder has a Tg less than about 10° F.

60. The composition according to claim 59, wherein said cross-linking, polymeric binder has a Tg between about −20° F. and −45° F.

61. The composition according to claim 34, wherein said cross-linking, polymeric binder is between about 0.01 and 35 weight percent of the total weight of said color binder print paste.

62. The composition according to claim 34, wherein said thickener adjusts the viscosity of said color binder print paste to about 10,000 cps.

63. The composition according to claim 34, further including a pH adjuster.

64. The composition according to claim 63, wherein said pH adjuster sets the pH of said color binder print paste to between about 7 and 12.

65. The composition according to claim 64, wherein said pH adjuster is ammonia.

66. A method for color printing articles formed from cellulose, said method comprising the steps of:

(a) printing the article with a dye blocking print paste (b) printing the article with a color binder print paste printed on the surface of said dye blocking print paste;

(c) printing the article with a dye enhancing print paste; and (d) dyeing the article.

67. A method for color printing articles formed from cellulose, said method comprising the steps of:

(a) printing the article with a dye blocking print paste composition, said composition comprising: a thickener, wherein said thickener for said dye blocking print paste is an acid stable concentrate comprising a polysaccharide; and dye blocking agents, said dye blocking agents including a ether-forming, cross-linking resin, an ester-forming, cross-linking resin, a catalyst and a dye resist, wherein said ether-forming cross-linking resin is a pre-catalyzed glyoxal resin, said catalyst is reductive, and said dye resist is a polyacrylic acid;

(b) printing the article with a color binder print paste printed on the surface of said dye blocking print paste, wherein said color binder print paste includes: (i) a pigment; (ii) a cross-linking, polymeric binder, and the balance water; and (c) dyeing the article.

68. A method for color printing articles formed from cellulose, said method comprising the steps of:

(a) printing the article with a dye blocking print paste composition, said composition comprising: a thickener, wherein said thickener for said dye blocking print paste is an acid stable concentrate comprising a polysaccharide; and dye blocking agents, said dye blocking agents including a ether-forming, cross-linking resin, an ester-forming, cross-linking resin, a catalyst and a dye resist, wherein said ether-forming cross-linking resin is a pre-catalyzed glyoxal resin, said catalyst is reductive, and said dye resist is a polyacrylic acid;

(b) printing the article with a color binder print paste printed on the surface of said dye blocking print paste, wherein said color binder print paste includes: (i) a pigment; (ii) a cross-linking, polymeric binder; and the balance water; and (c) printing the article with a dye enhancing print paste, said dye enhancing print paste including: (i) a thickener, wherein said thickener for said dye blocking print paste is an acid stable concentrate comprising a polysaccharide; and (ii) an enhancing agent, wherein said enhancing agent is a quaternary ammonium compound; and dyeing the article.

69. An article formed from cellulose and printed with a dye blocking print paste prior to dyeing; a color binder print paste on the surface of said dye blocking print paste; and a dye enhancing print paste printed on the surface of said color binder print paste.

* * * * *